US009297220B2

(12) United States Patent
Beck et al.

(10) Patent No.: US 9,297,220 B2
(45) Date of Patent: Mar. 29, 2016

(54) TUBING APPARATUS AND ASSOCIATED METHODS

(75) Inventors: Leigh Beck, Aberdeen (GB); Colin Nicol, Aberdeen (GB)

(73) Assignee: Helix Energy Solutions (U.K.) Limited, Aberdeen (GB)

( * ) Notice: Subject to any disclaimer, the term of this patent is extended or adjusted under 35 U.S.C. 154(b) by 173 days.

(21) Appl. No.: 13/810,416

(22) PCT Filed: Jul. 15, 2011

(86) PCT No.: PCT/GB2011/001061

§ 371 (c)(1), (2), (4) Date: Feb. 8, 2013

(87) PCT Pub. No.: WO2012/007724

PCT Pub. Date: Jan. 19, 2012

(65) Prior Publication Data

US 2013/0213662 A1 Aug. 22, 2013

(30) Foreign Application Priority Data

Jul. 16, 2010 (GB) ..... 1011996.4

(51) Int. Cl.

| | |
|---|---|
| ***E21B 7/12*** | (2006.01) |
| ***E21B 19/00*** | (2006.01) |
| ***E21B 19/15*** | (2006.01) |
| ***E21B 19/22*** | (2006.01) |

(52) U.S. Cl.

CPC ..... *E21B 19/004* (2013.01); *E21B 19/155* (2013.01); *E21B 19/22* (2013.01)

(58) Field of Classification Search

CPC ..... E21B 19/004; E21B 19/155; E21B 19/22

USPC ..... 166/351, 367, 77.2

See application file for complete search history.

(56) References Cited

U.S. PATENT DOCUMENTS

| | | | | |
|---|---|---|---|---|
| 3,750,898 | A | 8/1973 | Ancey et al. | |
| 4,621,403 | A | 11/1986 | Babb et al. | |
| 5,738,173 | A * | 4/1998 | Burge et al. | 166/385 |
| 7,231,981 | B2 * | 6/2007 | Moe et al. | 166/355 |
| 7,357,184 | B2 | 4/2008 | Patton et al. | |

(Continued)

FOREIGN PATENT DOCUMENTS

| | | | |
|---|---|---|---|
| EP | 0418057 | A1 | 3/1991 |
| GB | 2137261 | A | 10/1984 |

(Continued)

OTHER PUBLICATIONS

International Search Report dated Feb. 8, 2013, in connection with related PCT/GB2011/001061 filed Jul. 15, 2011.

(Continued)

*Primary Examiner* — Matthew R Buck
*Assistant Examiner* — Aaron Lembo
(74) *Attorney, Agent, or Firm* — Downs Rachlin Martin PLLC

(57) ABSTRACT

A coiled tubing lifting frame (10) for deploying coiled tubing in a riser (32). The coiled tubing lifting frame (10) comprises a coiled tubing injector (12) and the frame (10) is configured to position the coiled tubing injector (12) relative to a support (44). The coiled tubing lifting frame (10) is configured to support the riser (32). Methods of deploying a riser (32) and coiled tubing in a riser (32), including supporting the riser (32) with a coiled tubing lifting frame (10).

7 Claims, 14 Drawing Sheets

(56) References Cited

U.S. PATENT DOCUMENTS

| | | | | |
|---|---|---|---|---|
| 7,370,707 | B2 * | 5/2008 | McDaniel et al. | 166/380 |
| 7,404,443 | B2 | 7/2008 | Patton et al. | |
| 7,784,546 | B2 * | 8/2010 | Patton | 166/355 |
| 2004/0089215 | A1 * | 5/2004 | Roodenburg et al. | 114/201 R |
| 2005/0189118 | A1 | 9/2005 | Moncus et al. | |
| 2006/0196672 | A1 | 9/2006 | Robichaux | |
| 2011/0005767 | A1 * | 1/2011 | Muff et al. | 166/345 |
| 2015/0096761 | A1 * | 4/2015 | Roodenburg et al. | 166/355 |

FOREIGN PATENT DOCUMENTS

| | | | |
|---|---|---|---|
| GB | 2431418 | A | 4/2007 |
| WO | 2009001088 | A1 | 12/2008 |
| WO | 2009016346 | A2 | 2/2009 |
| WO | 2009026205 | A2 | 2/2009 |

OTHER PUBLICATIONS

Written Opinion dated Feb. 8, 2013, in connection with related PCT/GB2011/001061 filed Jul. 15, 2011.

Snorre Furberg et al., New Topside Solutions for Coiled Tubing Floater Operations; SPE 74813, Apr. 9, 2002; pp. 1-9; ISBN978-1-55563-952-5.

* cited by examiner

TUBING APPARATUS AND ASSOCIATED METHODS

TECHNICAL FIELD

The invention relates to tubing handling apparatus for use at drilled bores, and associated methods. In particular, but not exclusively, the invention relates to apparatus and methods for deploying coiled tubing in offshore well-bores.

BACKGROUND

Wells may be bored for various purposes, such as for accessing underground deposits. Reserves of hydrocarbons are commonly extracted through bored well-holes. The boring of well-holes and the subsequent extraction of hydrocarbons through the boreholes requires various operations to be performed underground.

Equipment may be transported in boreholes by a number of means, such as by wireline; by motorised vehicle or tractor; by pushing or injecting tubing into the borehole; or by rotation. Different underground operations require different means for transporting equipment underground. For example, operations involving pumping fluids into or out of a borehole typically require use of tubular members, such as coiled tubing.

Coiled tubing is also useful in circumstances where access using wireline tools is impeded. Where there is a blockage in a borehole or gravity is insufficient to overcome friction, coiled tubing may be preferred to wireline. However, coiled tubing operations require large equipment in comparison with wireline operations. The coiled tubing itself is heavy and the reel carrying the coiled tubing typically requires a large work area or footprint. The manipulation of coiled tubing often requires heavy lifting equipment, such as an injector that is used to insert and extract coiled tubing in the borehole.

Boreholes located underwater can be accessed from the water surface by risers. Typically a wellhead is located on the seabed and the riser provides an access conduit between the wellhead and the surface.

SUMMARY OF THE INVENTION

According to a first aspect of the invention there is provided a coiled tubing lifting frame for deploying coiled tubing in a riser, the coiled tubing lifting frame comprising a coiled tubing injector, the frame being configured to position the coiled tubing injector relative to a support, and wherein the coiled tubing lifting frame is further configured to support a riser.

A coiled tubing lifting frame that positions a coiled tubing injector relative to a support and that is able to support a riser allows coiled tubing to be deployed in a riser from a moving support, such as a winch or crane provided on a floating vessel, without requiring a further device to control the position of the injector.

The coiled tubing lifting frame may be configured to apply a tensile force to a riser, and/or may be configured to apply a variable force to a riser. The weight of coiled tubing supported by the coiled tubing lifting frame may vary as coiled tubing is injected into and/or extracted from the riser.

The coiled tubing lifting frame may be configured to maintain a riser tension. For example, the coiled tubing lifting frame may be configured to maintain a riser in tension at a predetermined value, or may be configured to maintain a riser in tension within a predetermined range. The coiled tubing lifting frame may be configured to controllably adjust a riser tension.

The coiled tubing lifting frame may be configured to exert a tension on a riser when a riser is connected to a wellhead. The wellhead may be located at a distal portion of a riser, for example on the sea bed. Alternatively, the wellhead may be located at a proximal portion of a riser.

The coiled tubing lifting frame may be configured to transfer a load from a riser to a support. Additionally, or alternatively the coiled tubing lifting frame may be configured to transfer a load from a support to a riser. The force may be a predetermined force. For example, the coiled tubing lifting frame may be configured to transfer a portion of a weight of a riser to a support. The weight may be a buoyant weight. The coiled tubing lifting frame may be configured to transfer at least a weight of a riser to a support. For example, the coiled tubing lifting frame may be configured to transfer a weight of a riser and a tensile force component to a support.

The coiled tubing lifting frame may be configured to position the coiled tubing injector relative to a riser. For example the coiled tubing lifting frame may be configured to maintain a position of the coiled tubing injector relative to a riser.

The coiled tubing lifting frame may be extendable. For example, the coiled tubing lifting frame may be extendable to vary a distance between the coiled tubing injector and a support.

The coiled tubing lifting frame may be longitudinally extendable, and/or may be vertically extendable. The coiled tubing lifting frame may comprise a riser attachment portion for attaching a riser to the lifting frame. The coiled tubing lifting frame may comprise a support attachment portion for attaching the lifting frame to a support. The coiled tubing lifting frame may be configured to vary a distance between the riser attachment portion and the support attachment portion. The riser attachment portion may be a lower portion and the support attachment portion may be an upper portion.

The coiled tubing lifting frame may be configured to compensate movement of a support relative to a riser. For example, the support may be buoyant, such as a floating support. The movement may comprise vertical movement. A riser may be fixed relative to a wellbore such that there may be relative vertical movement between a riser and a support (e.g. heave). Additionally, or alternatively, the movement may comprise horizontal movement (e.g. drift-off or drive-off).

The coiled tubing lifting frame may be configured to accommodate vertical movement of a support, such as heave, relative to a wellhead. Additionally, or alternatively the coiled tubing lifting frame may be configured to accommodate horizontal movement, such as drift-off, of a support relative to a wellhead.

The support may be a suspensive support. For example, the support may comprise a winch, winch cable or crane, such as a winch from a derrick.

The coiled tubing lifting frame may be configured to dynamically support a riser. For example, the coiled tubing lifting frame may comprise a fluid-actuated cylinder such that a load can be exerted on a riser (e.g. a force exerted on a riser may be proportional to a pressure in the cylinder and/or the pressure in the cylinder may be proportional to a force exerted by a riser). The coiled tubing lifting frame may be configured to adjust a load exerted on a riser. For example, the cylinder may be configured for adjustment of the pressure. The coiled tubing lifting frame may be configured to adjust a load exerted on a riser in response to a measured or sensed parameter. For example, a riser tension measurement device may be configured to provide indication of riser tension. The coiled tubing lifting frame may be configured to adjust a load exerted on the riser in response to measured riser tension. The load adjustment may be a difference between the measured riser tension and a target riser tension. The riser tension may be directly measured. Additionally, or alternatively, the riser tension may be indirectly measured. The riser tension may be a tension in a portion of a riser. The riser tension measurement device may form part of the coiled tubing lifting frame.

The frame may be configured to cooperate with a support in the form of a lifting device. For example, the frame may be configured for at least partial attachment to a lifting device. A lifting device, such as a winch, may provide at least partial riser tension during at least a portion of a deployment and/or of an operation of the coiled tubing lifting frame. The coiled tubing lifting frame may be configured such that a first portion of riser tension is provided by the frame and a second portion of riser tension is provided by a riser tensioning device. The relative proportion of the first portion of riser tension to the second portion of riser tension may vary during deployment and/or operation. The first portion of riser tension may be variable. Additionally, or alternatively the first portion of riser tension may be constant. The second portion of riser tension may be constant. Additionally, or alternatively the second portion of riser tension may be variable. The nature of the first and/or second portions of riser tension may vary during deployment and/or operation. For example, a first portion of riser tension may be constant then variable. A constant portion of riser tension may be zero. A variable portion of riser tension may compensate for differences between a constant portion of riser tension and a target riser tension.

The frame may be configured to compensate riser tension for load variations, such as during the injection and/or retrieval of tubing and/or of equipment. For example, the frame may be configured to adjust a load applied to a riser within a time interval in proportion to a time interval corresponding to typical load variations.

Additionally or alternatively, the coiled tubing lifting frame may be configured to compensate riser tension for movement of a riser relative to a support. For example a fluid-actuated cylinder provided in the frame may have a stroke, the stroke allowing for relative movement between a riser and a support. The stroke may be at least about 2 meters, at least about 4 meters, or at least about 8 meters.

The coiled tubing lifting frame may be configured to adjust a position of the coiled tubing injector relative to a support, in response to a signal. The signal may be indicative of a riser tension; and/or of a riser position relative to a support.

According to a second aspect of the invention there is provided a method of deploying coiled tubing in a riser, the method comprising:

providing a coiled tubing lifting frame comprising a coiled tubing injector, the frame configured to position the injector relative to a support, wherein the frame is further configured to support a riser;

injecting coiled tubing in a riser;

varying a position of the injector relative to the support; and supporting the riser with the coiled tubing lifting frame.

The method may further comprise performing operations in a bore. Additionally, or alternatively, the method may further comprise attaching the coiled tubing lifting frame to a riser.

The method may further comprise positioning the coiled tubing lifting frame and/or the riser over a wellhead.

The method may further comprise attaching the riser to a wellhead.

The method may comprise maintaining a riser tension within a predetermined range.

Additionally or alternatively the method may comprise maintaining a riser tension at a constant value.

The method may comprise controllably adjusting a riser tension.

The method may comprise attaching coiled tubing to equipment in the riser. For example a tool string may be positioned at least partially in the riser and coiled tubing attached thereto.

The method may comprise disconnecting the riser from a wellhead.

The riser may be disconnected from the wellhead prior to tool change out operations.

The riser may be supported by a riser support device. For example, the riser may be supported by a lifting device, such as a winch.

The riser may be supported by a riser support device during tool change out operations. For example, the riser may be hung off, such as in a moonpool door land-off adaptor, during tool change out operations.

According to a third aspect of the invention there is provided a coiled tubing apparatus comprising a coiled tubing lifting frame according to the first aspect and further comprising a riser.

The riser may be rigid.

Additionally, or alternatively, the riser may be flexible. For example, the riser may comprise a flexible portion. The flexible portion may provide for relative movement between the frame and a wellhead. The flexible portion may provide for relative movement between the frame and a riser.

According to a fourth aspect of the invention there is provided a coiled tubing lifting frame deployment apparatus comprising a guide surface, the guide surface configured to position at least a portion of a coiled tubing lifting frame during deployment.

The deployment apparatus may be configured to provide passive guidance to the at least a portion of a coiled tubing lifting frame. For example, the guide surface may define a path for the at least a portion of a coiled tubing lifting frame during deployment. For example, the guide surface may define a path guiding the at least a portion of a coiled tubing lifting frame towards a deployed position.

The deployment apparatus may be configured to position the at least a portion of a coiled tubing lifting frame relative to a lifting device. For example, the guide surface may define a path guiding the at least a portion of a coiled tubing lifting frame towards a position below a winch or crane.

The guide surface may define a substantially linear path. For example, the deployment apparatus may comprise a rail, the rail comprising a straight guide surface. Additionally, or alternatively, the guide surface may define an arcuate path. For example, the rail may comprise a curved section.

The at least a portion of a coiled tubing lifting frame may be an end portion of a coiled tubing lifting frame. For example, the guide surface may be configured to position an end portion that is a lower end portion when the coiled tubing lifting frame is in a deployed configuration.

The guide surface may be configured to position the at least a portion of a coiled tubing lifting frame during retrieval of a coiled tubing lifting frame.

The deployment apparatus may be configured to provide resistance to movement of the at least a portion of a coiled tubing lifting frame. The deployment apparatus may be configured to provide resistance to movement of the at least a portion of a coiled tubing lifting frame in a first direction. For example, the guide surface may be configured to receive the at least a portion of a coiled tubing lifting frame to restrain movement in a first direction. Additionally, the deployment apparatus may be configured to provide resistance to movement of the at least a portion of a coiled tubing lifting frame in a second direction. Additionally, the deployment apparatus may be configured to provide resistance to movement of the at least a portion of a coiled tubing lifting frame in a second direction. Additionally, the deployment apparatus may be configured to provide resistance to movement of the at least a portion of a coiled tubing lifting frame in a third direction. Additionally, the deployment apparatus may be configured to provide resistance to movement of at least portion of the lifting frame in a fourth direction. The deployment apparatus may provide resistance to lateral movement. Additionally, or alternatively, the deployment apparatus may provide resistance to vertical movement. Additionally, or alternatively the deployment apparatus may provide resistance to horizontal movement, such as longitudinal movement. The deployment apparatus may provide greater resistance in a first direction compared to a second direction. The deployment apparatus may comprise multiple guide surfaces, each guide surface configured to provide movement resistance in a different single direction. Additionally, or alternatively, a single guide surface may be configured to provide movement resistance in multiple directions.

The resistance to movement may prevent movement in a particular direction. Alternatively, the movement in the particular direction may be allowed and the resistance to movement may apply a braking force in the particular direction of movement.

The deployment apparatus may be configured to provide sequential resistance to movement. The deployment apparatus may comprise a first guide surface configured to define a first path of the at least a portion of a coiled tubing lifting frame and a second guide surface configured to define a second path of the at least a portion of a coiled tubing lifting frame, the second path succeeding the first path. For example, a first guide surface may substantially prevent substantially vertical movement of the at least a portion of a coiled tubing lifting frame during a first phase of deployment, such as vertical movement during erection of a coiled tubing lifting frame, and a second guide surface may substantially prevent substantially horizontal movement of the at least a portion of a coiled tubing lifting frame during a subsequent phase of deployment, such as during connection of a coiled tubing lifting frame to another device, such as a riser.

The deployment apparatus may be configured to provide active guidance to the at least a portion of a lifting frame. For example, the deployment apparatus may be powered. The deployment apparatus may be configured to provide a variable load to the at least a portion of a lifting frame. The deployment apparatus may be configured to apply a braking load to the at least a portion of a lifting frame. Additionally, or alternatively, the deployment apparatus may be configured to apply a propelling load to the at least a portion of a lifting frame.

The coiled tubing lifting frame deployment apparatus may be configured for rotation of the at least a portion of a coiled tubing lifting frame during deployment. For example the deployment apparatus may be configured to cooperate with a rotation device, such as a pivot. The pivot may be an axis, such as an axis defined by a hinge. The rotation device may form part of the deployment apparatus. Additionally or alternatively, the rotation device may form part of the coiled tubing lifting frame. The rotation device may be configured for rotation of the at least a portion of a coiled tubing lifting frame from a stored configuration to a deployed configuration. The rotation device may be configured to allow the lifting frame to rotate between vertical and horizontal positions and/or various positions therebetween.

The rotation device may be configured to adjust the angle of elevation of the at least a portion of a coiled tubing lifting frame. For example, the rotation device may be powered. The rotation device may be configured to apply a load to the at least a portion of the coiled tubing lifting frame. For example, the rotation device may comprise a cylinder, the load applied to the at least a portion of a coiled tubing lifting frame being proportional to a pressure in the cylinder. The pressure in the cylinder may be controlled, for example in response to target position and/or orientation of the coiled tubing lifting frame. The rotation device may form part of the deployment apparatus. Additionally, or alternatively, the rotation device may form part of a coiled tubing lifting frame.

The deployment apparatus may be configured to control the position of a first portion of a coiled tubing lifting frame whilst a second portion is manipulated by a lifting device. For example the deployment apparatus may be configured to restrict the vertical movement of the first portion whilst the second portion is raised or lowered by the lifting device. The deployment apparatus may be configured to translate the first portion substantially horizontally whilst the second portion is translated substantially vertically.

The position of the first portion may be fixed relative to the second portion.

The deployment apparatus may form part of the coiled tubing lifting frame.

The deployment apparatus may form part of a storage apparatus for a coiled tubing lifting frame. For example, the deployment apparatus may form part of a storage basket, the storage basket used for storage and/or transportation of the coiled tubing lifting frame when not deployed.

According to a fifth aspect of the invention there is provided a coiled tubing lifting frame comprising a deployment apparatus according to the fourth aspect.

According to a sixth aspect of the invention there is provided a method of deploying a coiled tubing lifting frame, the method comprising:

providing a coiled tubing lifting frame deployment apparatus comprising a guide surface;

positioning the coiled tubing lifting frame relative to a lifting device;

attaching a first portion of the lifting frame to the deployment apparatus;

attaching a second portion of the lifting frame to the lifting device;

raising and/or lowering the lifting frame with the lifting device; and guiding the movement of the first portion with the guide surface.

The movement of the first portion may be guided along a path defined by the guide surface. A horizontal movement of the first portion may be guided. Additionally, or alternatively, a vertical movement of the first portion may be guided.

The orientation of the lifting frame during raising or lowering by the lifting device may be altered. For example the lifting frame may be rotated relative to a horizontal axis, such as translated between substantially horizontal and substantially vertical positions, and/or positions therebetween.

The guide surface may determine a horizontal position of the first portion of the lifting frame during raising or lowering by the lifting device. Additionally, or alternatively, the guide surface may determine a vertical position of the first portion of the lifting frame during raising or lowering by the lifting device.

The method may further comprise guiding the movement in a first direction and then guiding the movement in a second direction. For example, the first portion may be guided by the guide surface along a substantially horizontal path during positioning of the coiled tubing lifting frame under a lifting device and then guided along a substantially vertical path during mating of the coiled tubing lifting frame with another device, such as a riser. The first portion may be guided in the second direction by the guide surface. Additionally, or alternatively the first portion may be guided in the second direction by a second guide surface.

According to a seventh aspect of the invention there is provided a tubular deployment apparatus comprising a tubular positioning device for positioning tubulars relative to a lifting device, wherein the positioning device comprises a guide member, the guide member configured to guide the movement of a tubular during deployment.

The tubular deployment apparatus may be configured to support a tubular at a first tubular portion. For example, the tubular deployment apparatus may comprise a gripper for gripping a tubular at a first tubular portion.

The tubular positioning device may be configured to provide passive guidance to a tubular. For example, the guide member may define a path for the tubular during deployment. For example, the guide member may define a path guiding the tubular towards a deployed position.

The tubular positioning device may be configured to position the tubular relative to a lifting device. For example, the guide member may define a path guiding the tubular towards a position below a winch.

The guide member may define a substantially linear path. For example, the tubular positioning device may comprise a rail, the rail comprising a straight guide member. Additionally, or alternatively, the guide member may define an arcuate path. For example, the rail may comprise a curved section.

The tubular positioning device may be configured to position or guide a first portion and then position a second portion. For example the first portion may be an end portion of a tubular, being an upper end portion when the tubular is deployed. The second portion may be a second end portion of a tubular, being a lower end portion when the tubular is deployed. The tubular positioning device may be configured to position or guide the first end portion for attachment to a lifting device. The tubular positioning device may be configured to position or guide the second end portion during lifting of the tubular by the lifting device.

The guide member may be configured to position at least a portion of a tubular during retrieval of a coiled tubing lifting frame.

The tubular positioning device may be configured to provide resistance to movement of the at least a portion of a tubular. The tubular positioning device may be configured to provide resistance to movement of the at least a portion of a tubular in a first direction. For example, the guide member may be configured to receive the tubular to restrain movement in a first direction. Additionally, the tubular positioning device may be configured to provide resistance to movement of the at least a portion of a tubular in a second direction. Additionally, the tubular positioning device may be configured to provide resistance to movement of the at least a portion of a tubular in a second direction. Additionally, the tubular positioning device may be configured to provide resistance to movement of the at least a portion of a tubular in a third direction. Additionally, the tubular positioning device may be configured to provide resistance to movement of the at least a portion of a tubular in a fourth direction. The tubular positioning device may provide resistance to lateral movement. Additionally, or alternatively, the tubular positioning device may provide resistance to vertical movement. Additionally, or alternatively the tubular positioning device may provide resistance to horizontal movement, such as longitudinal movement. The tubular positioning device may provide greater resistance in a first direction compared to a second direction. The tubular positioning device may comprise multiple guide members, each guide member configured to provide movement resistance in a different single direction. Additionally, or alternatively, a single guide member may be configured to provide movement resistance in multiple directions.

The resistance to movement may prevent movement in a particular direction. Alternatively, movement in a particular direction may be allowed and the resistance to movement may be a braking force in the particular direction of movement.

The tubular positioning device may be configured to provide sequential resistance to movement. The tubular positioning device may comprise a first guide member configured to define a first path of the at least a portion of a tubular and a second guide member configured to define a second path of the at least a portion of a tubular, the second path succeeding the first path. For example, a first guide member may substantially prevent substantially vertical movement of a portion of the tubular during a first phase of deployment, such as vertical movement during erection of a tubular, and a second guide member may substantially prevent substantially horizontal movement of a portion of the tubular during a subsequent phase of deployment, such as during connection of the tubular to another device, such as another tubular to form a riser.

The tubular positioning device may be configured to provide active guidance to the at least a portion of a tubular. For example, the tubular positioning device may be powered. The tubular positioning device may be configured to provide a variable load to the at least a portion of a tubular. The tubular positioning device may be configured to apply a braking load to the at least a portion of a tubular. Additionally, or alternatively, the tubular positioning device may be configured to apply a propelling load to the at least a portion of a tubular.

The tubular positioning device may be configured for rotation of the tubular during deployment. For example the tubular positioning device may be configured to cooperate with a rotation device, such as a pivot. The pivot may be an axis, such as an axis defined by a hinge. The rotation device may form part of the tubular deployment apparatus. Additionally or alternatively, the rotation device may form part of the lifting device. The rotation device may be configured for rotation of the tubular from a stored configuration to a deployed configuration. The rotation device may be configured to allow the tubular to rotate between vertical and horizontal positions and/or various positions therebetween.

The rotation device may be configured to adjust the angle of elevation of the tubular. For example, the rotation device may be powered. The rotation device may be configured to apply a load to the tubular. For example, the rotation device may comprise a cylinder, the load applied to the tubular being proportional to a pressure in the cylinder. The pressure in the cylinder may be controlled, for example in response to target position and/or orientation of the tubular. The rotation device may form part of the tubular deployment apparatus. Additionally, or alternatively, the rotation device may form part of a lifting device.

The tubular positioning device may be configured to control the position of a first portion of a tubular whilst a second portion is manipulated by a lifting device. For example the tubular positioning device may be configured to restrict the vertical movement of the first portion whilst the second portion is raised or lowered by the lifting device. The tubular positioning device may be configured to translate the first portion substantially horizontally whilst the second portion is translated substantially vertically.

The position of the first portion may be fixed relative to the second portion.

The tubular deployment apparatus may form part of the lifting device.

The tubular deployment apparatus may be configured to position a tubular relative to a tubular storage apparatus. For example, the tubular positioning device may be configured to move tubulars from a stored position in a storage apparatus to a first deployed position in a storage apparatus, such as centrally under a lifting device.

The tubular positioning device may form part of the storage apparatus for tubulars. For example, the tubular positioning device may form part of a tubular storage basket, the storage basket used for storage and/or transportation of the tubulars when not deployed.

The positioning device may be configured to support a tubular at a first tubular portion when the tubular is not attached to a lifting device.

The positioning device may be configured to support a tubular at a second tubular portion when a tubular is attached to a lifting device.

The second tubular portion may be different from the first tubular portion.

The tubular deployment apparatus may be configured to cooperate with a lifting device such as a winch or crane. For example the tubular positioning device may be configured to guide the position of a first tubular portion whilst the lifting device guides the position of a second tubular portion.

The positioning device may be configured to move a tubular. For example, the positioning device may be powered.

The positioning device may be configured to position a tubular relative to a lifting device prior to lifting of a tubular by a lifting device. Additionally, or alternatively, the positioning device may be configured to position a tubular relative to a lifting device during lifting of a tubular by a lifting device. Additionally, or alternatively, the positioning device may be configured to position a tubular relative to a lifting device after lifting of a tubular by a lifting device. Additionally, or alternatively, the positioning device may be configured to position a tubular relative to a further device.

The positioning device may be configured to position a tubular longitudinally. The positioning device may be configured to position a tubular laterally. For example, the positioning device may be configured to position a tubular on a central plane or axis. The positioning device may be configured to position a tubular vertically.

According to an eighth aspect of the invention there is provided a storage apparatus comprising a tubular deployment apparatus according to the seventh aspect of the present invention.

The storage apparatus may be configured to attach to a transportation device. For example, the storage apparatus may be configured to attach to a skid and/or a lorry. The storage apparatus may be a tubular storage apparatus.

The tubular storage apparatus may be configured to attach to at least a further storage apparatus. For example, the tubular storage apparatus may comprise slots for receiving corresponding protrusions from a second tubular storage apparatus, mounting pins securing the first and second tubular storage apparatus together. Additionally, or alternatively the tubular storage apparatus may be configured to attach to a coiled tubing lifting frame storage apparatus.

According to a ninth aspect of the invention there is provided a method of deploying tubulars, the method comprising:

providing a tubular deployment apparatus comprising a guide member;

positioning a tubular relative to a lifting device;

supporting the tubular at a first portion with the deployment apparatus;

attaching the tubular to the lifting device at a second portion;

lifting the tubular with the lifting device; and guiding the tubular during lifting with the guide member.

The tubular may be attached at the second portion to a lifting device prior to supporting the tubular at the first portion. Alternatively the tubular may be supported at the first portion prior to being attached at the second portion to a lifting device.

The movement of the first portion may be guided along a path defined by the guide member. A horizontal movement of the first portion may be guided. Additionally, or alternatively, a vertical movement of the first portion may be guided.

The orientation of the tubular during lifting by the lifting device may be altered. For example the tubular may be rotated relative to a horizontal axis, such as translated between substantially horizontal and substantially vertical positions, and/or positions therebetween.

The guide member may determine a horizontal position of the first portion of the tubular during lifting by the lifting device. Additionally, or alternatively, the guide member may determine a vertical position of the first portion of the tubular during lifting by the lifting device.

The method may further comprise guiding the movement of the tubular in a first direction with the tubular in a fixed orientation, such as horizontal, and then guiding the movement in a second direction with the tubular in a variable orientation, such as translation from horizontal to vertical. The second direction may be the same as the first direction. The first and/or second direction may be defined by the guide member.

According to a tenth aspect of the invention there is provided a method of retrieving a first coiled tubing member from a well-bore, the method comprising:

deploying a fishing tool to prepare an end portion of the first coiled tubing for attachment to a second coiled tubing member;

deploying the second coiled tubing member from a reel via a coiled tubing lifting frame on a floating support, the coiled tubing lifting frame connected to the well-bore via a riser;

attaching the first coiled tubing member to the second coiled tubing member at a join, wherein the join is of substantially the same external diameter as an external diameter of the second coiled tubing member;

spooling the second coiled tubing member onto the reel.

The method may further comprise spooling the first coiled tubing member onto the reel.

The method may further comprise supporting the marine riser with the coiled tubing lifting frame.

The external diameter of the join may be configured to be substantially the same as the external diameter of the first coiled tubing member. The external diameters of the first and second coiled tubing members may be configured to be substantially the same. By providing a join of substantially the same external diameter as the second coiled tubing member, the join is able to be processed by the same equipment as the second coiled tubing member, such as an injector and/or a stripper and/or a lubricator. By providing a second coiled tubing member of substantially the same external diameter as the first coiled tubing member, the first coiled tubing member is able to be processed by the same equipment as the second coiled tubing member, such as an injector and/or a stripper and/or a lubricator.

The internal diameter of the join may be configured to be substantially the same as the internal diameter of the second coiled tubing member. The internal diameter of the join may be configured to be substantially the same as the internal diameter of the first coiled tubing member. The internal diameters of the first and second coiled tubing members may be configured to be substantially the same. By providing a join of substantially the same internal diameter as the first coiled tubing member, equipment is able to pass through the join to and/or from the first coiled tubing member. By providing a second coiled tubing member of substantially the same internal diameter as the first coiled tubing member, equipment is able to pass through to and/or from the first coiled tubing member from and/or to the second coiled tubing member. By providing the join, the first and second coiled tubing members with substantially the same internal diameter, fluid is able to pass through the join, the first and second coiled tubing members with substantially the same flow characteristics.

According to an eleventh aspect of the invention there is provided a coiled tubing lifting frame comprising an injector for injecting coiled tubing, wherein the coiled tubing lifting frame is adapted to receive coiled tubing in the injector when the lifting frame is in a stored configuration and in a deployed configuration.

The stored configuration may be a substantially horizontal configuration or orientation. The deployed configuration may be a substantially vertical configuration or orientation.

The coiled tubing lifting frame may comprise an injector;

a coiled tubing guide; and a coiled tubing guide actuator, wherein the coiled tubing guide actuator is configured to adjust the coiled tubing guide relative to the injector.

The coiled tubing guide actuator may be configured to adjust an angle of the coiled tubing guide relative to the coiled tubing injector.

The coiled tubing guide actuator may be configured to adjust the coiled tubing guide relative to the injector dependent on the configuration of the coiled tubing lifting frame. For example, the coiled tubing guide actuator may be configured to vary an angle between the coiled tubing guide and the coiled tubing injector dependent on the orientation of the coiled tubing lifting frame, such as vertical or horizontal or orientations therebetween. Additionally, or alternatively, the coiled tubing guide actuator may be configured to adjust the coiled tubing guide in response to a load. For example, the coiled tubing guide actuator may dampen movement of the coiled tubing, such as in response to changes in load due to injection and/or retrieval of coiled tubing, including stick-slip. The coiled tubing guide actuator may be configured to maintain a position of the coiled tubing guide.

The coiled tubing guide actuator may comprise a cylinder.

The coiled tubing guide may be configured to define at least a portion of a path of a coiled tubing from a coiled tubing reel to the coiled tubing injector.

The coiled tubing guide may be curved (e.g. a gooseneck).

The coiled tubing lifting frame may be configured to provide a separation between the coiled tubing lifting frame and at least a portion of a coiled tubing path between the injector and a coiled tubing reel. The coiled tubing lifting frame may be configured to define a reduced separation in a first configuration compared to a second configuration. For example, the separation in a first configuration may define a height of the coiled tubing path. By providing a reduced height of the coiled tubing path, the coiled tubing lifting frame with coiled tubing inserted may be more easily handled, such as transported and/or stored. Enabling a coiled tubing lifting frame to be transported and/or stored with coiled tubing inserted may improve efficiency, such as by reducing time to deploy coiled tubing. Enabling coiled tubing to be inserted in a coiled tubing lifting frame in a different configuration from a deployed configuration may improve safety. For example, inserting coiled tubing in a coiled tubing lifting frame with the coiled tubing lifting frame in a substantially horizontal configuration may reduce the height of operations and/or reduce man-riding operations.

According to a twelfth aspect of the invention there is provided a coiled tubing lifting frame compensation apparatus, the compensation apparatus comprising:

a fluid reservoir;

a cylinder; the cylinder configured for fluid connection to the reservoir; and a release valve configured to vent fluid from the cylinder.

The release valve may be configured to vent fluid to a surrounding environment, such as atmospherically, and may bypass the fluid reservoir.

The release valve may be an emergency release valve. For example, the release valve may be configured to release pressure in the event of an emergency disconnect procedure, such as a drift-off The compensation apparatus may be a motion compensation apparatus. The compensation apparatus may be a heave compensation apparatus.

The compensation apparatus may be a force compensation apparatus.

The fluid may be a hydraulic fluid. The fluid may be water-based. Alternatively, the fluid may be oil-based.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to any of the second, third, fourth, fifth, tenth, etc. aspects, without the need to explicitly and unnecessarily list those various combinations and permutations here.

It will be appreciated that one or more embodiments/aspects may be useful in handling tubing for use in conjunction with a bore.

BRIEF DESCRIPTION OF THE DRAWINGS

The present invention will be further described by way of non-limiting examples only with reference to the accompanying drawings, in which.

DETAILED DESCRIPTION OF THE DRAWINGS

Figure 1:
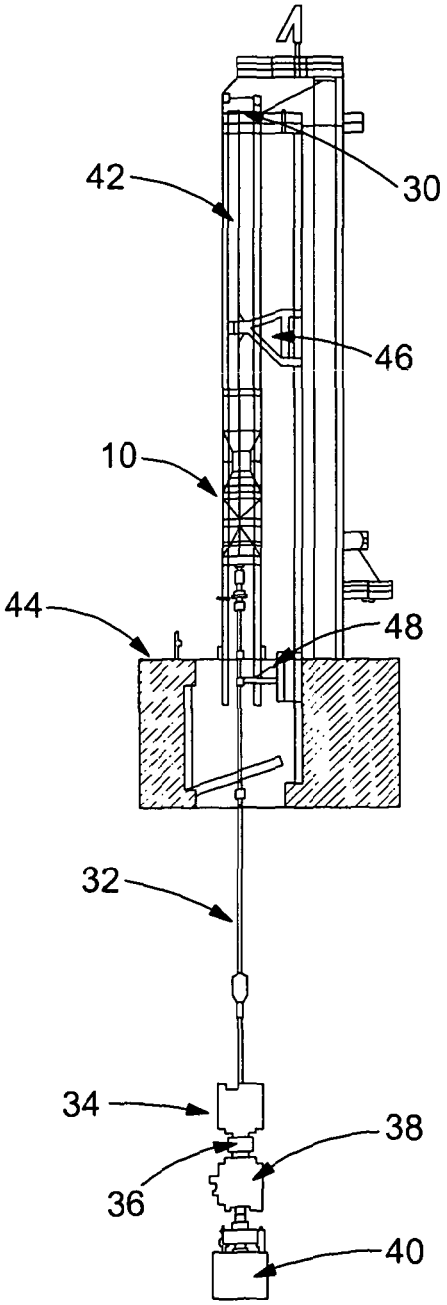
FIG. 1 shows a schematic representation of a coiled tubing lifting frame in accordance with an embodiment of the invention in use connected to a tower and further connected to a riser connected to a wellhead.

Reference is first made to FIG. 1 in which there is shown a coiled tubing lifting frame 10 for deploying coiled tubing in a riser in accordance with a first embodiment of the invention in use connected to a tower winch 30 and a marine riser 32. The riser 32 is connected via an upper riser assembly 34, an emergency disconnect package 36 and a lower riser assembly 38 to a wellhead tree 40. The coiled tubing lifting frame 10 is suspended from the tower winch 30 via a winch cable 42. When the riser 32 is connected to the wellhead tree 40, the tower winch 30 is static: that is, the winch 30 does not move the winch cable 42. The tower winch 30 is supported on a deck 44 of a floating vessel such that the position of the tower winch 30 is moveable relative to the wellhead tree 40 or the riser 32 due to movement of the vessel on the water surface, such as heave, pitch or drift. The coiled tubing lifting frame 10 supports the weight of the riser 32.

An upper trolley 46 centralises the winch cable 42 to define a horizontal position of the coiled tubing lifting frame 10 relative to the tower winch 30. A moonpool centraliser 48 defines a horizontal position of the riser 32 relative to the deck 44.

The coiled tubing lifting frame 10 is used to inject coiled tubing into the riser 32 from a reel. Various tools may be connected to the coiled tubing for performing operations in the riser and/or the well/bore. The coiled tubing may also be used for pumping fluids into or out of the well/bore. The coiled tubing lifting frame 10 is also used to retrieve the coiled tubing onto the reel.

Figure 2:
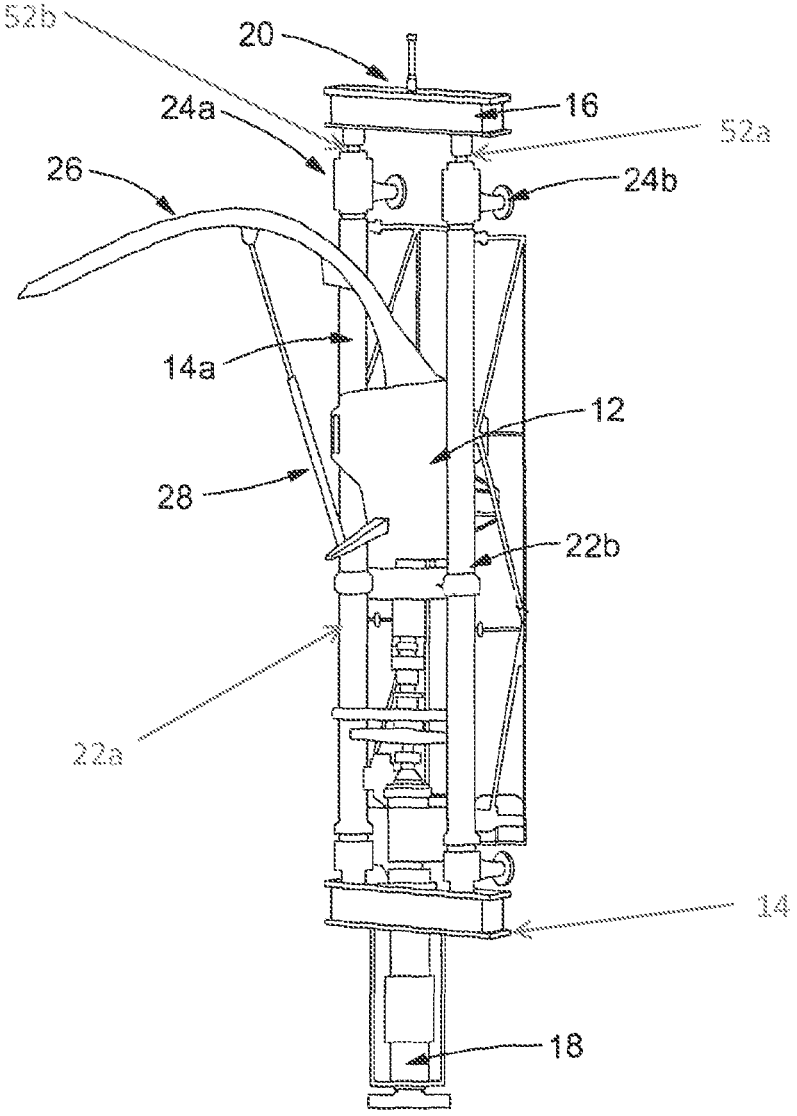
FIG. 2 shows the coiled tubing lifting frame of FIG. 1.

FIG. 2 shows the coiled tubing lifting frame 10 of FIG. 1 in isolation. The coiled tubing lifting frame 10 comprises a coiled tubing injector 12 and is configured 10 to vary the position of the coiled tubing injector 12 relative to a support, and the frame 10 is further configured to apply a force to the riser 32. In the embodiment shown, the coiled tubing lifting frame 10 has a lower portion 14 configured to connect to the riser 32 and an upper portion 16 configured to connect to a support in the form of the winch 30. The lower portion 14 comprises a riser mating interface 18 for connecting 15 the coiled tubing lifting frame 10 to the riser 32. The upper portion 16 comprises a lifting interface 20 for connecting the coiled tubing lifting frame 10 to the winch 30.

The lower portion 14 is connected to the upper portion 16 via two hydraulic cylinders 22*a*, 22*b*. Each hydraulic cylinder 22*a*, 22*b* has a stroke length enabling the coiled tubing lifting frame 10 to extend or contract vertically such that the distance 20 between the lower portion 14 and the upper portion 16 is defined.

Each cylinder 22*a*, 22*b* has an attachment interface 24*a*, 24*b* for attaching to a fluid reservoir, forming part of a compensation apparatus. The coiled tubing lifting frame 10 further comprises a gooseneck 26 and a gooseneck piston 28. Pressure in the cylinders 22*a*, 22*b* is sufficient to counteract the weight of the riser 32. Supporting the riser 32 by the coiled tubing lifting frame reduces load on the upper riser assembly 34, the emergency disconnect package 36; the lower riser assembly 38; or the wellhead tree 40. Furthermore, the pressure in the cylinders 22*a*, 22*b* exerts an additional upward force on the riser 32, maintaining the riser 32 in tension. Maintaining the riser 32 in tension helps prevent damage to the riser 32 and/or equipment in the riser 32, such as buckling of the riser 32.

The force applied to the riser 32 by the cylinders 22*a*, 22*b* is adjusted by adjusting the pressure in the cylinders 22*a*, 22*b*. The applied riser 32 tension is adjusted in response to a measurement of the riser 32 by a riser monitoring system. Factors such as current; passage of equipment (e.g. coiled tubing) within the riser; vessel movement; etc. influence tension in the riser 32 such that the applied force requires adjustment to maintain the riser 32 tension within a target range. The coiled tubing lifting frame 10 supports the weight of coiled tubing such that the pressure in the cylinders 22*a*, 22*b* requires adjustment in response to a variation in the weight of coiled tubing or equipment; for example as coiled tubing is run into or out of the riser 32.

Figure 3:
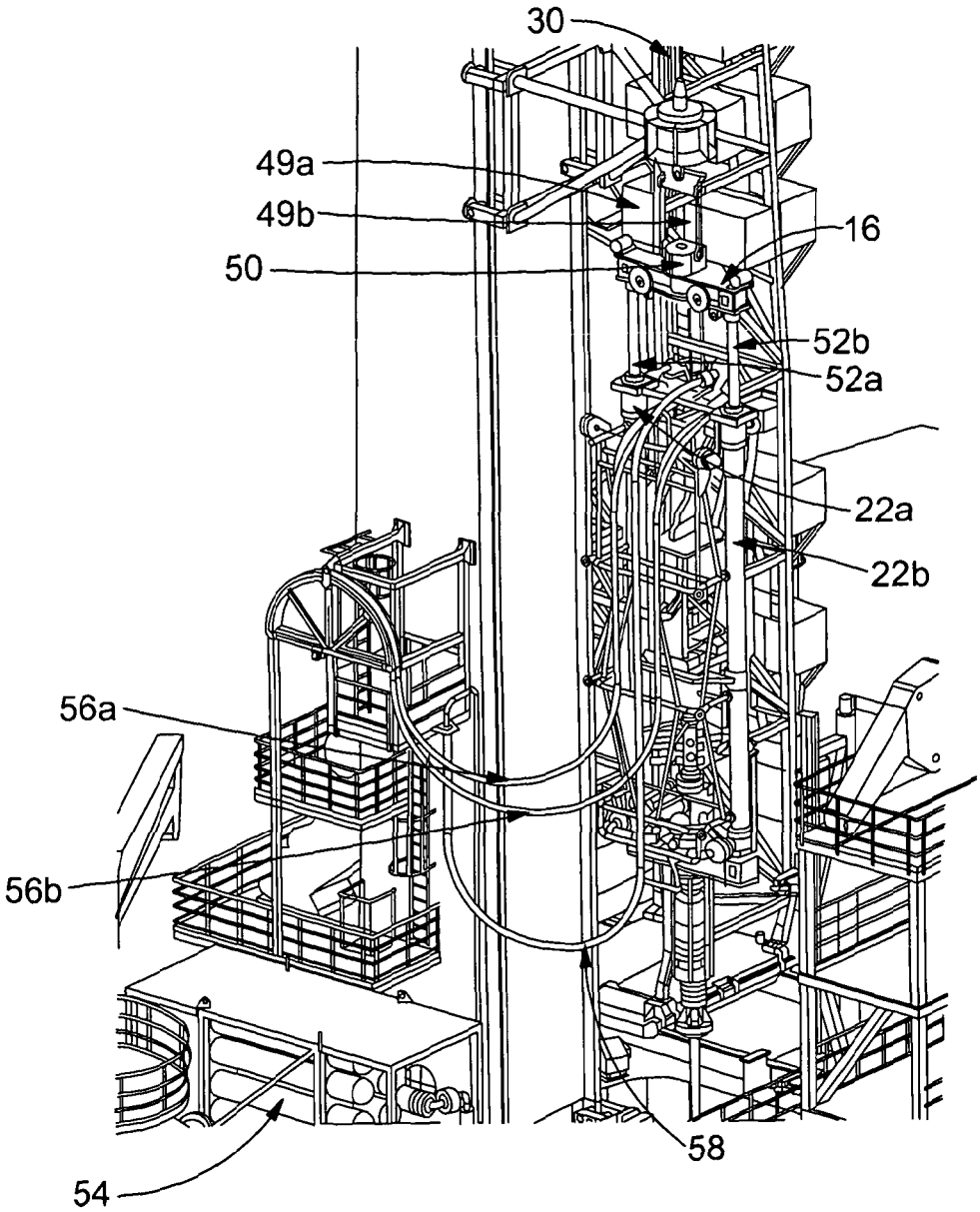
FIG. 3 shows the coiled tubing lifting frame of FIG. 1 in use suspended from a tower winch with the lifting frame in a neutral configuration.

FIG. 3 shows the coiled tubing lifting frame 10 of FIG. 1 in use suspended from a tower winch 30 with the coiled tubing lifting frame 10 hung off in a neutral configuration. The coiled tubing lifting frame 10 is attached to the winch cable 42 via two bails 49*a*, 49*b* and an elevator 50. The upper portion 16 is attached to two shafts 52*a*, 52*b* of the respective cylinders 22*a*, 22*b*. The cylinders 22*a*, 22*b* are connected to a fluid reservoir 54 via respective fluid supply hoses 56*a*, 56*b*. A fluid returns hose 58 returns fluid to the fluid supply 54.

In the neutral configuration, the cylinders 22*a*, 22*b* are partially extended to expose portions of the shafts 52*a*, 52*b* indicative of a maximum relative upward travel of the lower portion 18 from the neutral configuration.

Figure 4:
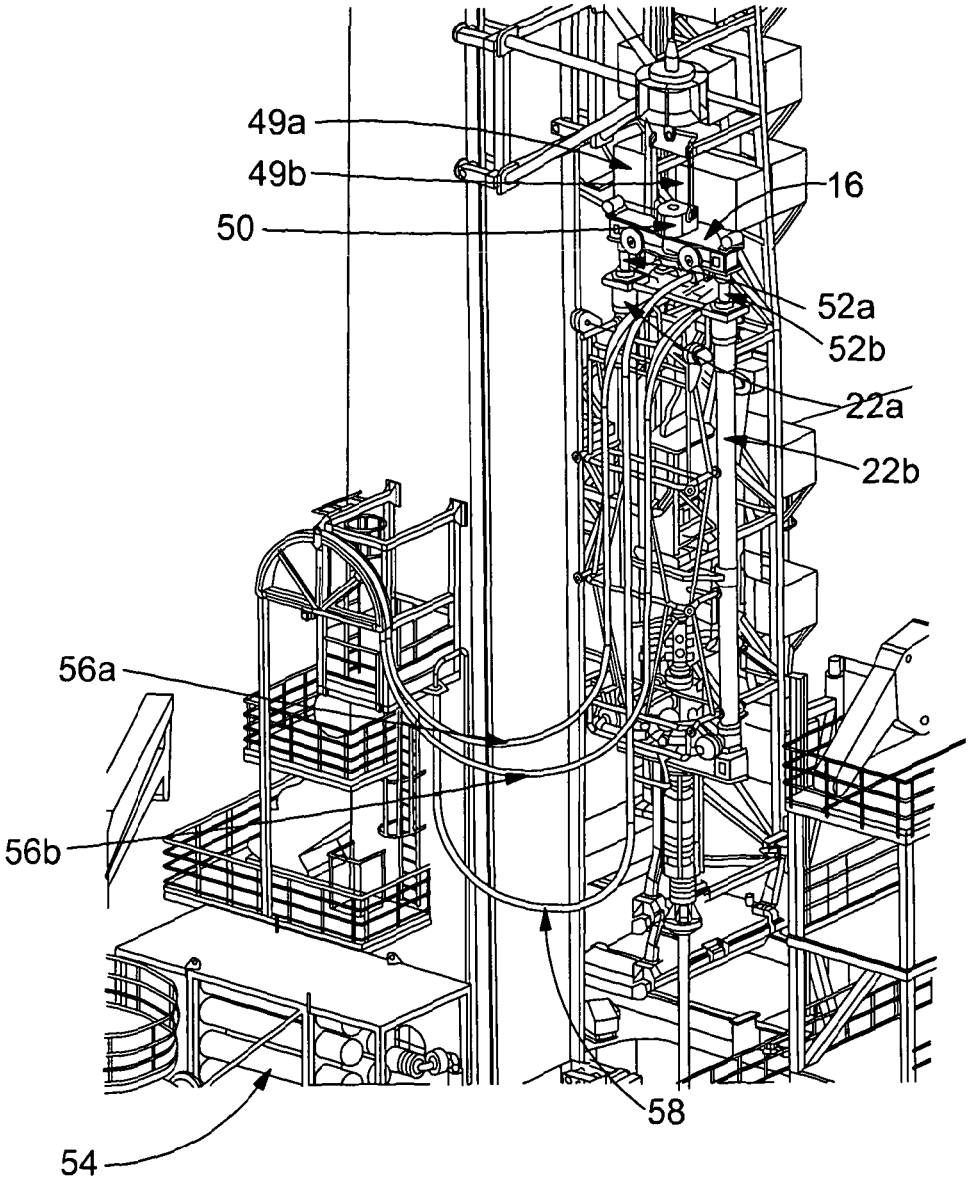
FIG. 4 shows the coiled tubing lifting frame of FIG. 1 in use suspended from a tower winch with the lifting frame in a maximum heave up configuration.

FIG. 4 shows the coiled tubing lifting frame 10 in a maximum heave up configuration. The exposed sections of the shafts 52*a*, 52*b* are reduced. The upper portion 16 remains in the same position relative to the deck 44 as in the neutral configuration. Compensation for relative motion between the vessel and the riser 32 by the coiled tubing lifting frame 10 enables the tower winch 30 and the winch cable 42 to remain static during motion compensation, such as heave compensation. Maintaining the winch cable 42 in a static position during motion compensation reduces stresses on the winch cable 42 and reduces the likelihood and/or the rate of fatigue in the winch cable 42.

Figure 5:
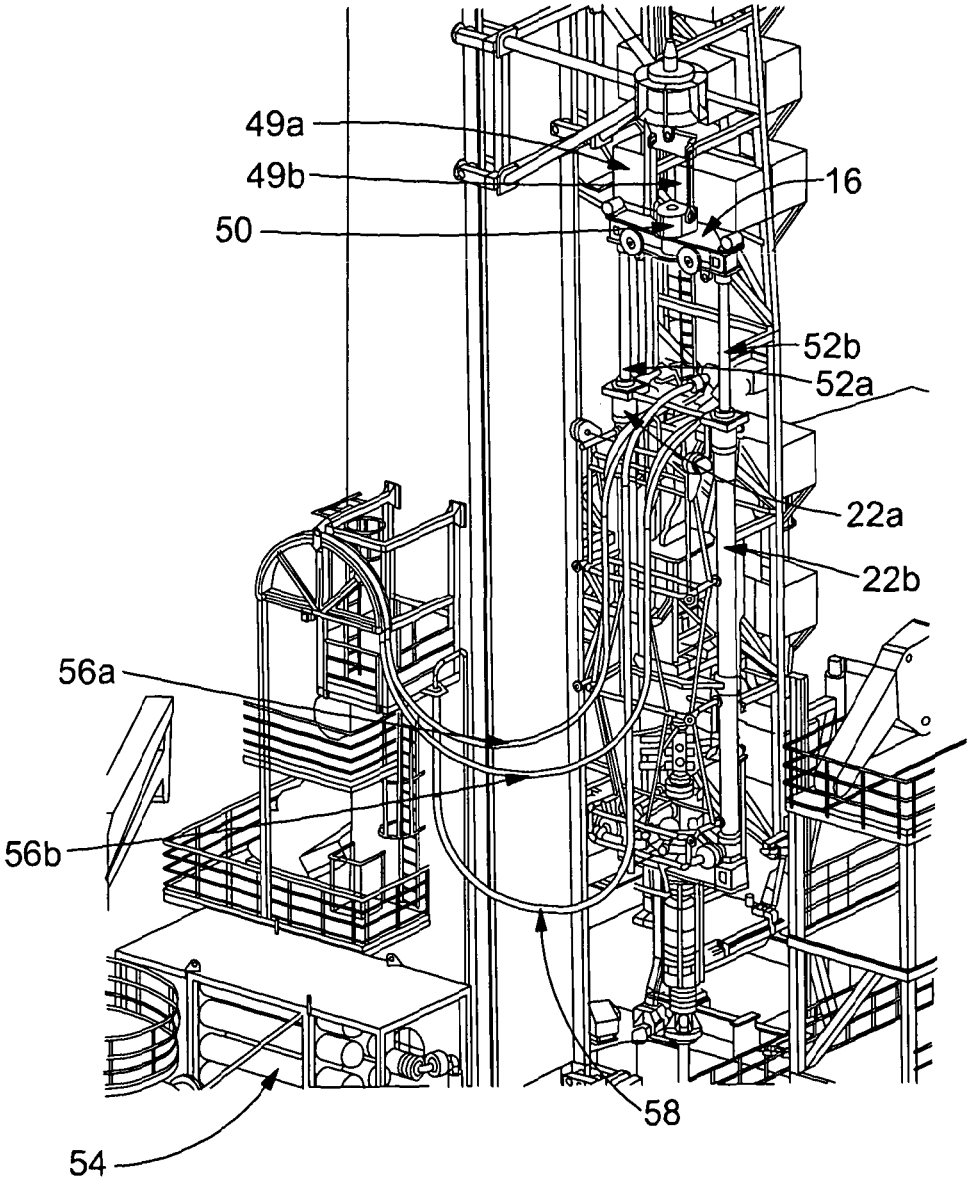
FIG. 5 shows the coiled tubing lifting frame of FIG. 1 in use suspended from a tower winch with the lifting frame in a heave down configuration.

FIG. 5 shows the coiled tubing lifting frame 10 in a heave down configuration. The exposed sections of the shafts 52*a*, 52*b* are increased compared to the neutral and the maximum heave up configurations. The upper portion 16 remains in the same position relative to the deck 44 as in the neutral and maximum heave up configurations. The maximum heave down configuration corresponds to the vessel being raised and/or displaced such that the distance from the vessel to the wellhead 40 is increased, which is compensated by the elongation of the coiled tubing lifting frame 10.

Figure 6:
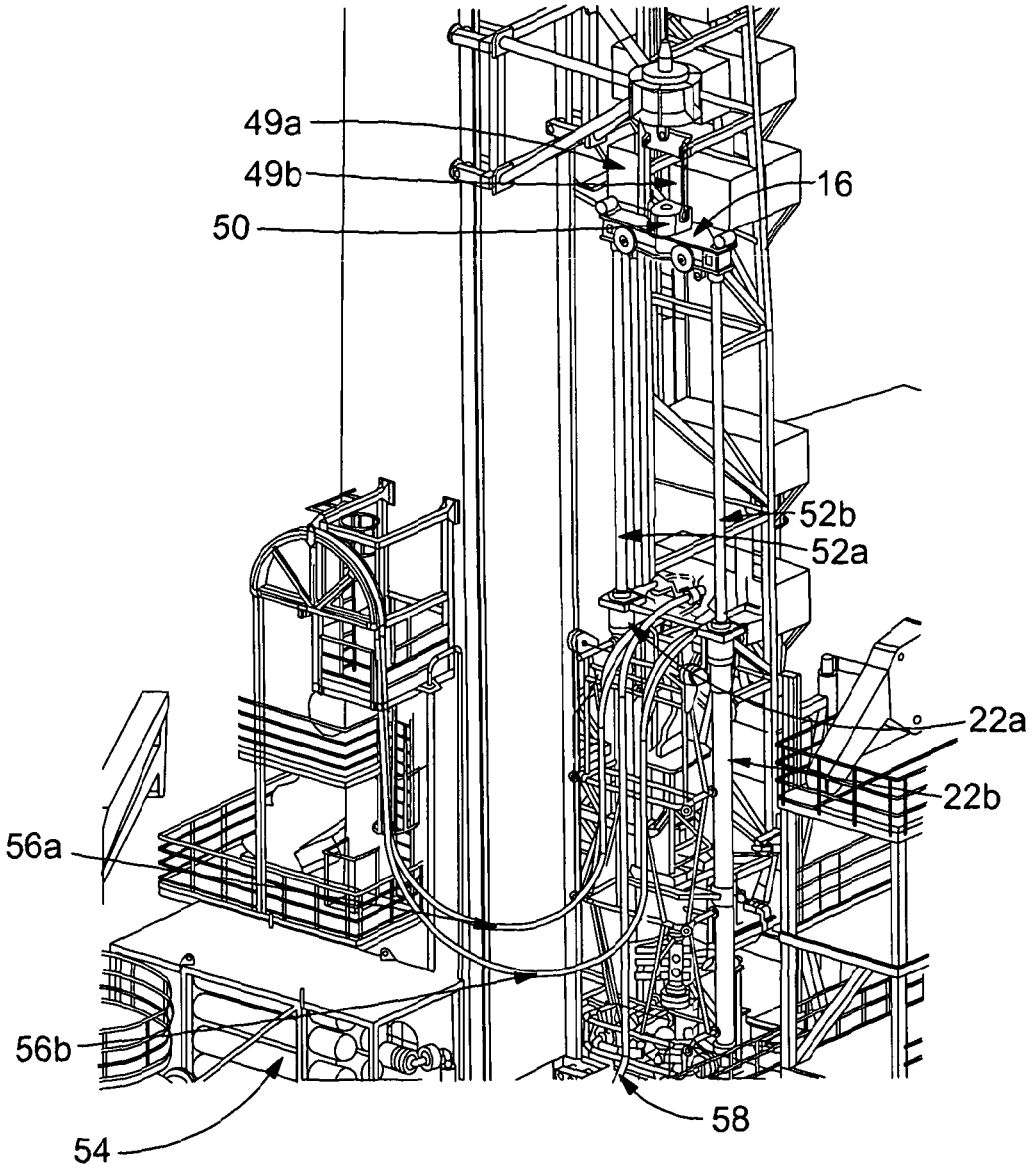
FIG. 6 shows the coiled tubing lifting frame of FIG. 1 in use suspended from a tower winch with the lifting frame in a disconnect configuration.

FIG. 6 shows the coiled tubing lifting frame 10 in a disconnect configuration. The disconnect configuration corresponds to a drift-off or drive-off scenario of the vessel, whereby the vessel is displaced relative to the wellhead 40. The expansion of the coiled tubing lifting frame 10 from the neutral configuration to the disconnect configuration provides for an effective elongation of the riser 32 system such that the vessel is able to be displaced whilst still connected to the riser 32; and maintaining the riser 32 in tension. The extension of the coiled tubing lifting frame 10 to the disconnect configuration provides for emergency disconnect procedures to be performed prior to disconnecting the riser 32. For example: equipment such as coiled tubing in the riser 32 is retracted, or at least partially retracted; and/or a pressure in the riser 32 is reduced; and/or a force applied to the riser 32 is reduced in anticipation of disconnecting or shearing at least a portion of the riser 32; and/or disconnecting or shearing equipment within the riser 32. A fluid reservoir 54 normally receives vented fluid via the returns hose 58; however, in an emergency disconnect procedure, the volume of fluid and/or the pressure in the cylinders 22*a*, 22*b* is rapidly reduced by venting the cylinders 22*a*, 22*b* through a valve which bypasses the fluid reservoir 54.

In the embodiment shown, the coiled tubing lifting frame 10 is configured to operate with an emergency disconnect package 36. The emergency disconnect package 36 is configured to disconnect when the riser 32 deviates outwith a predetermined angle with respect to the wellhead 40. The length of the riser 32, the emergency disconnect package 36 and the coiled tubing lifting frame 10 are configured to define a time interval for performing an emergency disconnect procedure. The effective riser 32 elongation provided by the coiled tubing lifting frame 10 in the disconnect configuration provides a time interval during movement from the neutral configuration or a heave configuration to the disconnect configuration in which to perform emergency disconnect procedures. For example, in a drift-off scenario, a trigger event or a combination of trigger events, such as a change in a position of the vessel and a change in the riser tension, causes the instigation of an emergency disconnect procedure. Thresholds for the instigation of an emergency disconnect procedure are set such that the elongation of the coiled tubing lifting frame 10 to the disconnect configuration accommodates a change in a position of the vessel and/or a potential increase in riser 32 tension. In the embodiment shown, the coiled tubing lifting frame 10 is configured to provide 8 meters of stroke in a disconnect configuration and the emergency disconnect package 36 is configured to safely disconnect at a deviation of up to 20 degrees. The amount of stroke provided in the disconnect configuration is configured to accommodate a riser 32 deviation compatible with the emergency disconnect package 36 and the length of the riser 32.

Figure 7:
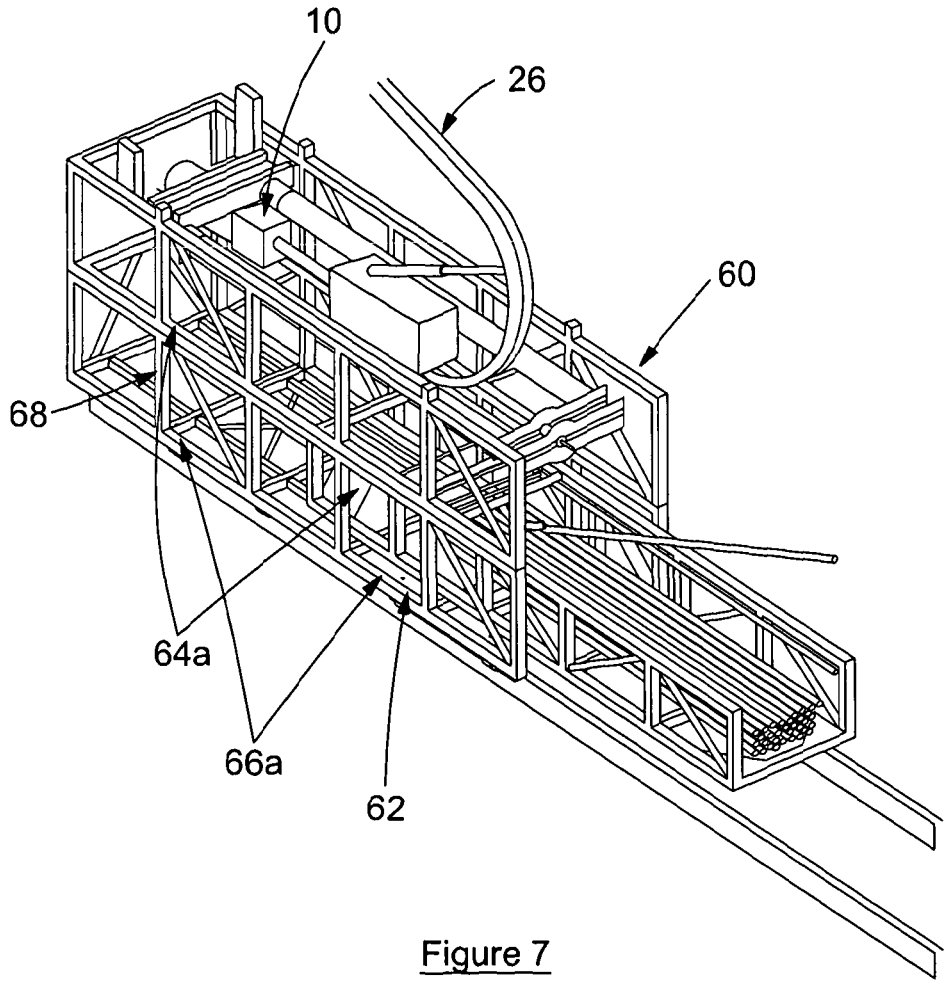
FIG. 7 shows the coiled tubing lifting frame of FIG. 1 in a stored configuration in a basket mounted atop a tubular storage basket.

FIG. 7 shows the coiled tubing lifting frame 10 of FIG. 1 in a stored configuration in a lifting frame basket 60 mounted atop a tubular storage basket 62. The lifting frame basket 60 is attached to the tubular storage basket 62 via pins 64*a* located fore and aft on either side of the lifting frame basket 60. A similar fixing arrangement of pins 66*a* attaches the tubular storage basket to a skid system 68. The pins 64*a*, 66*a* are configured for attaching baskets 60, 62 to each other, or to a skid system 68, or to a transportation system such as a lorry or container.

The coiled tubing lifting frame 10 in the stored configuration is substantially horizontal, with the gooseneck 26 aloft. The lifting frame basket 60 has a substantially open structure, providing access to the coiled tubing lifting frame 10. The lifting frame 10 in the stored configuration provides access to the lifting frame 10, enabling inspection or maintenance of the lifting frame 10 without a necessity to work at height or with a suspended load. In the stored configuration, equipment such as coiled tubing can be inserted or removed from the lifting frame 10. Enabling equipment to be handled or inserted in the lifting frame 10 in the stored configuration, allows, for example, equipment to be inserted prior to deployment of the lifting frame 10, thus simplifying operations, such as saving time, during or after deployment of the lifting frame 10. Similarly, enabling removal of equipment from a lifting frame 10 in the stored configuration allows equipment to be removed after retrieval of the lifting frame 10, thus simplifying operations during or after retrieval of the lifting frame 10.

Figure 8:
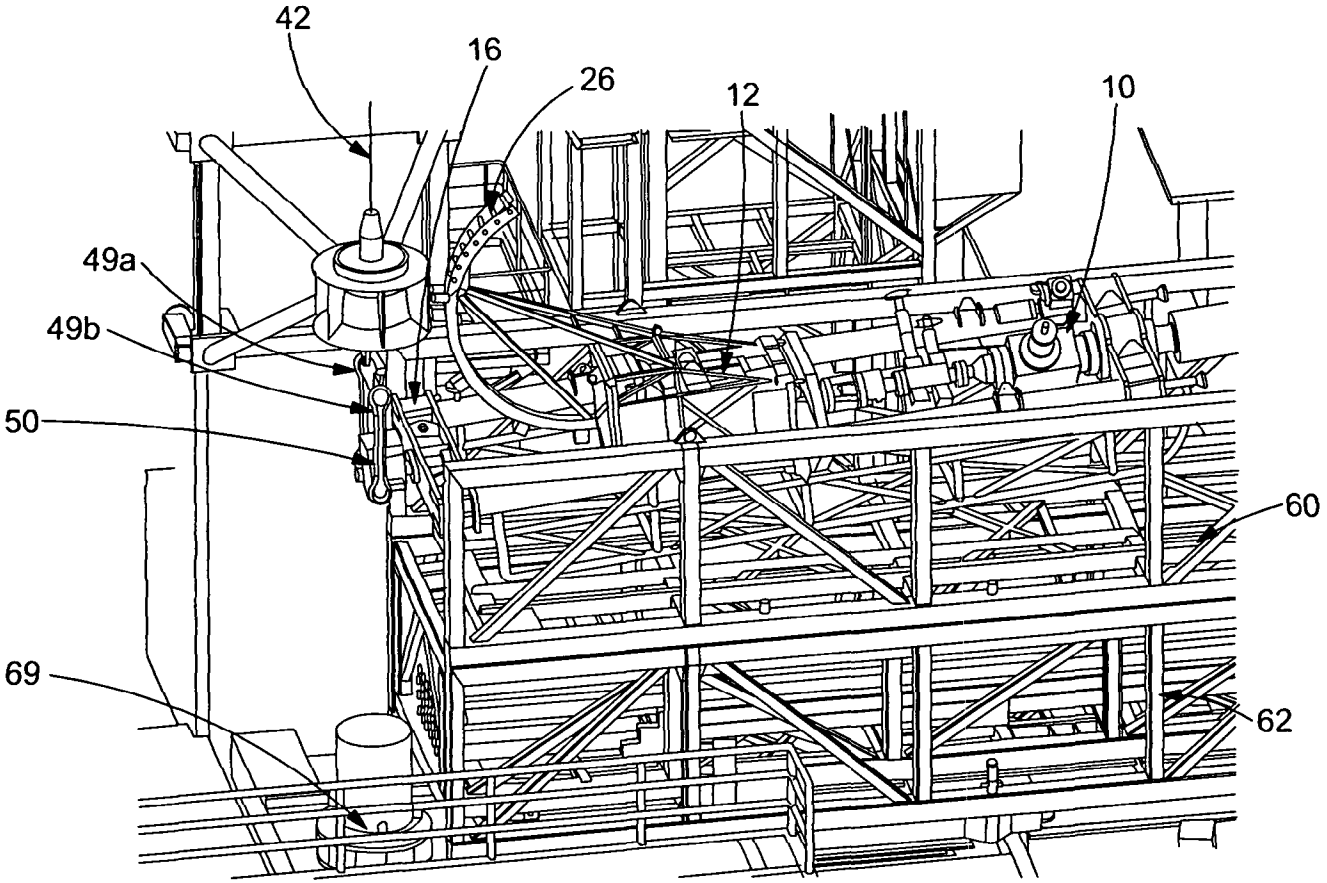
FIG. 8 shows the coiled tubing lifting frame of FIG. 1 in a first partially deployed configuration in a basket.

FIG. 8 shows the coiled tubing lifting frame 10 of FIG. 1 in a first partially deployed configuration in the lifting frame basket 60 mounted atop the tubular storage basket 62 of FIG. 7. The baskets 60, 62 have been skidded into proximity of a moonpool 69. The upper portion 16 of the coiled tubing lifting frame 10 is attached to the winch cable 42 via two bails 49*a*, 49*b* and an elevator 50. Coiled tubing is inserted in the coiled tubing injector 12 via the gooseneck 26.

Figure 9A:
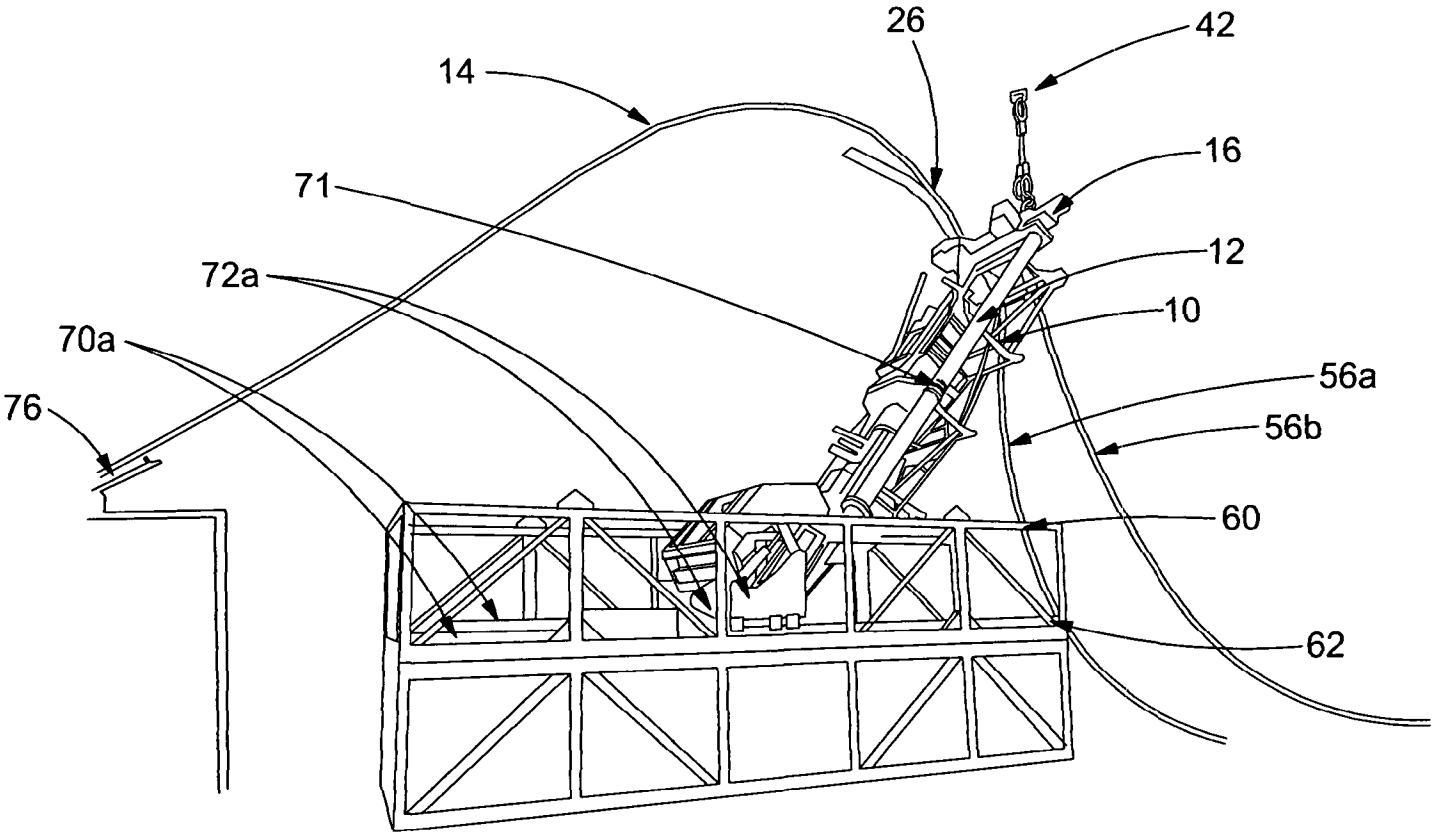
FIG. 9*a* shows the coiled tubing lifting frame of FIG. 1 in a second partially deployed configuration proximal to a riser mating interface.

FIG. 9 shows the coiled tubing lifting frame 10 of FIG. 1 in a second partially deployed configuration. The upper portion 16 is suspended from the winch cable 42 and raised substantially vertically. The lower portion 14 is attached to two horizontal guidance rails 70*a* of the lifting frame basket 60 via a deployment carriage 71. In the embodiment shown, brakes 72*a* are used to apply resistive forces to movement of the coiled tubing lifting frame 10 along the guidance rails 70*a* to control the movement of the coiled tubing lifting frame 10. The coiled tubing lifting frame 10 in the stored configuration is configured to define a coiled tubing 74 stored path from a coiled tubing reel 76 to the injector 12. The deployment of the coiled tubing lifting frame 10 from the stored configuration to the deployed configuration is configured to alter the path of the coiled tubing 74 from the stored path to a deployed path, such as a lazy loop. The coiled tubing lifting frame 10 is communicably connected to the coiled tubing reel 76 such that tension in the coiled tubing 74 and/or the path of the coiled tubing 74 is controlled by the coiled tubing reel 76 and/or the injector 12 during deployment and/or operation of the coiled tubing lifting frame 10.

The arrangement of the supply hoses 56*a*, 56*b* and the returns hose is configured such that the coiled tubing lifting frame 10 moves from the stored configuration to the deployed configuration whilst attached to the fluid reservoir.

Figure 9B:
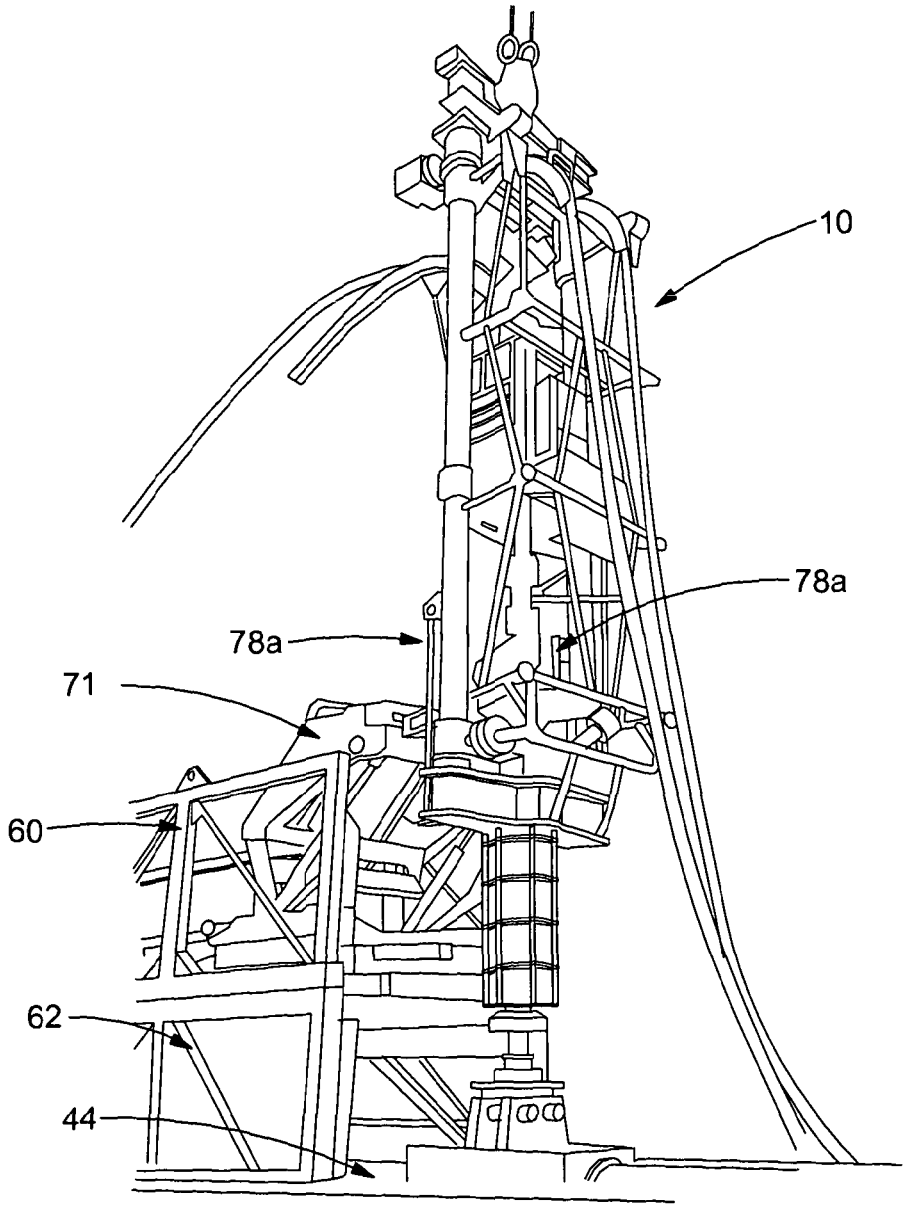
FIG. 9*b* shows the coiled tubing lifting frame of FIG. 1 in a third partially deployed configuration proximal to a riser mating interface.

FIG. 9*b* shows the coiled tubing lifting frame 10 of FIG. 1 in a third partially deployed configuration. The coiled tubing lifting frame 10 is vertical, suspended from the winch cable 42 and connected to the deployment carriage 71 via vertical guidance rails 78*a*. The vertical guidance rails 78*a* enable the coiled tubing lifting frame 10, including the lower portion 14, when substantially vertical to be raised or lowered by the winch cable 42. The deployment carriage 71 is used to align the coiled tubing lifting frame 10 longitudinally relative to the basket 60 for mating with equipment, such as a bottom hole assembly and/or the riser 32. The coiled tubing lifting frame 10 is laterally aligned for mating using a lateral positioning cylinder 80 which forms part of the deployment carriage 71 in the embodiment shown.

Figure 10:
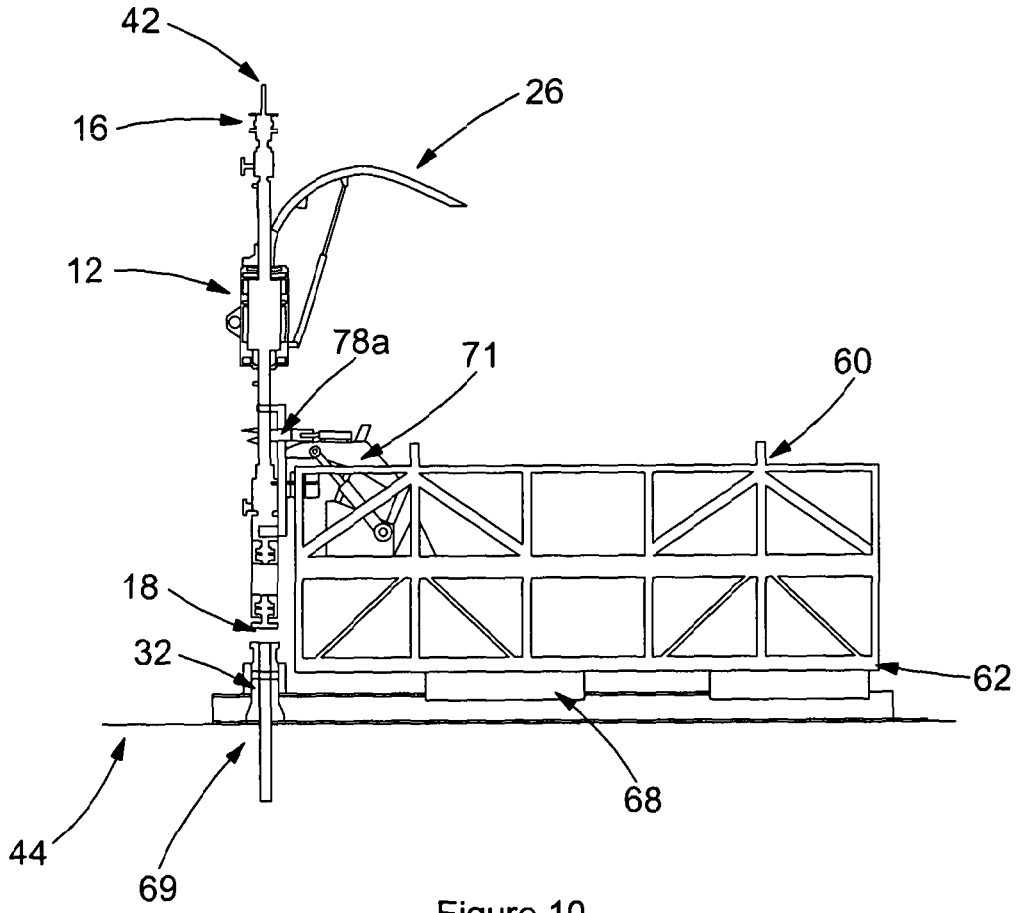
FIG. 10 shows a schematic side view of the coiled tubing lifting frame of FIG. 1 in the third partially deployed configuration of FIG. 9*b*.

FIG. 10 shows a schematic side view of the coiled tubing lifting frame 10 of FIG. 1 in the third partially deployed configuration of FIG. 9*b*. The vertical guidance rails 78*a* aid the positioning of the coiled tubing lifting frame 10 for mating. The coiled tubing lifting frame 10 remains attached to the vertical guidance rails 78*a* during raising or lowering of the coiled tubing lifting frame 10 such that the coiled tubing lifting frame 10 is attached to the deck 44 at all times during suspension from the winch cable 42 when not attached to the riser 32. The coiled tubing lifting frame 10 is therefore unable to freely move when suspended from the winch cable 42, eliminating the danger of a swinging suspended load. The coiled tubing lifting frame 10 is releasably attached to the deployment carriage 71, such that when the coiled tubing lifting frame is mated with the riser 32, the coiled tubing lifting frame 10 is disconnected from the deployment carriage 71 and the baskets 60, 62 skidded away from the moonpool 69.

Figure 11:
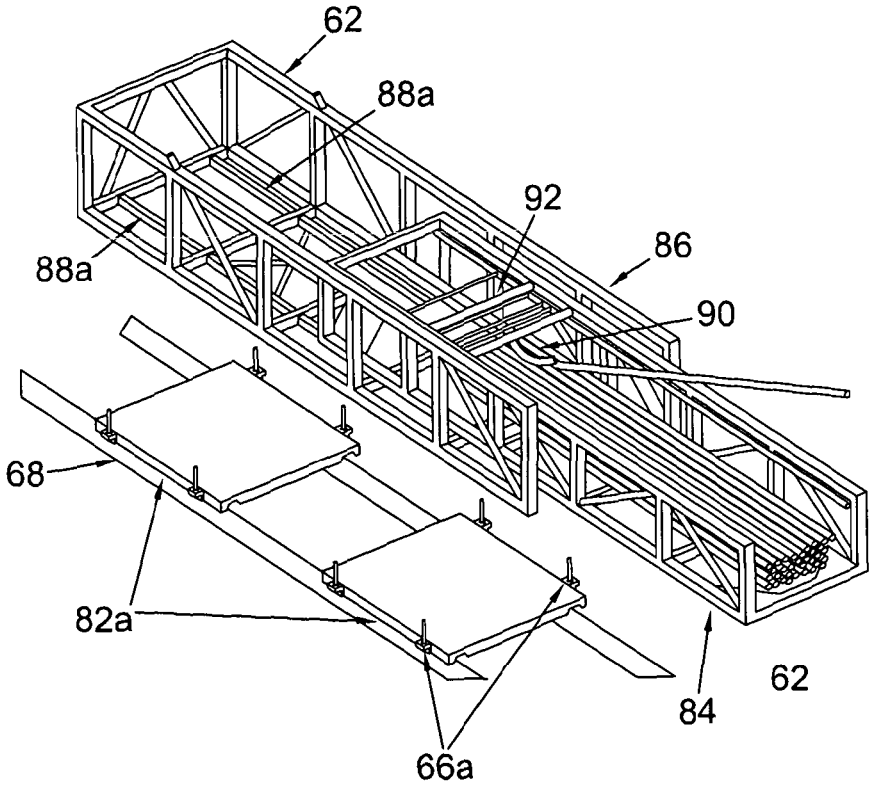
FIG. 11 shows the tubular storage basket of FIG. 6 with an exploded view of a skid attachment.
Figure 12:
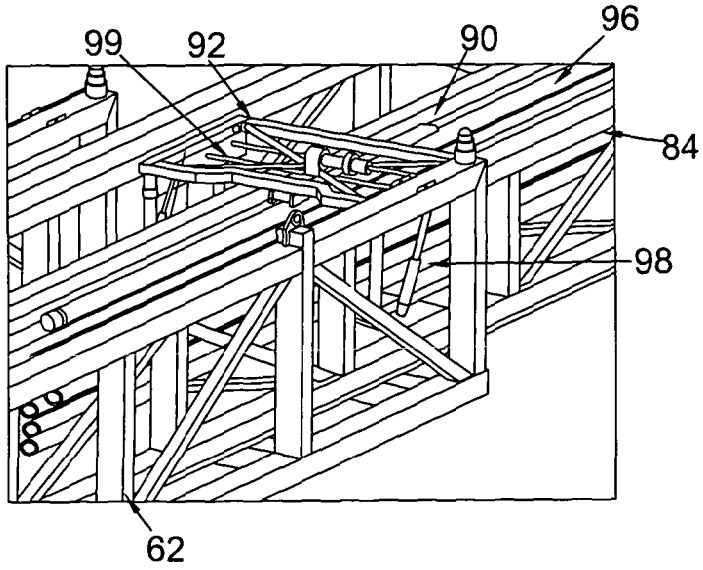
FIG. 12 shows an enlarged view of a gripper of the tubular storage basket of FIG. 6.
Figure 13A:
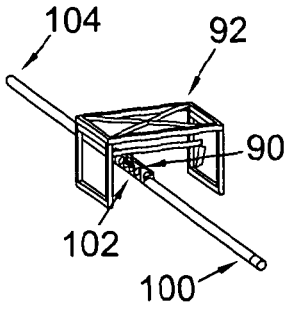
FIGS. 13(*a*), 13(*b*) and 13(*c*) show a detail of the gripper of FIG. 12 with a tubular in respective lateral positions, with some other components removed for clarity.
Figure 13B:
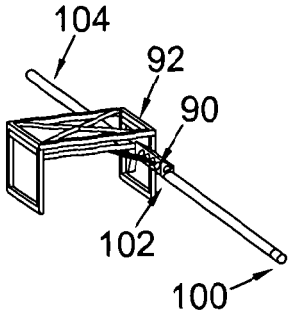
Figure 13C:
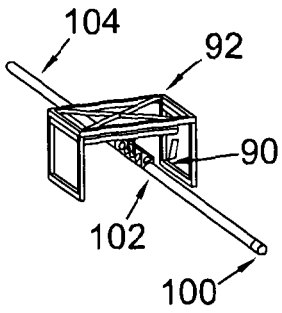
Figure 14A:
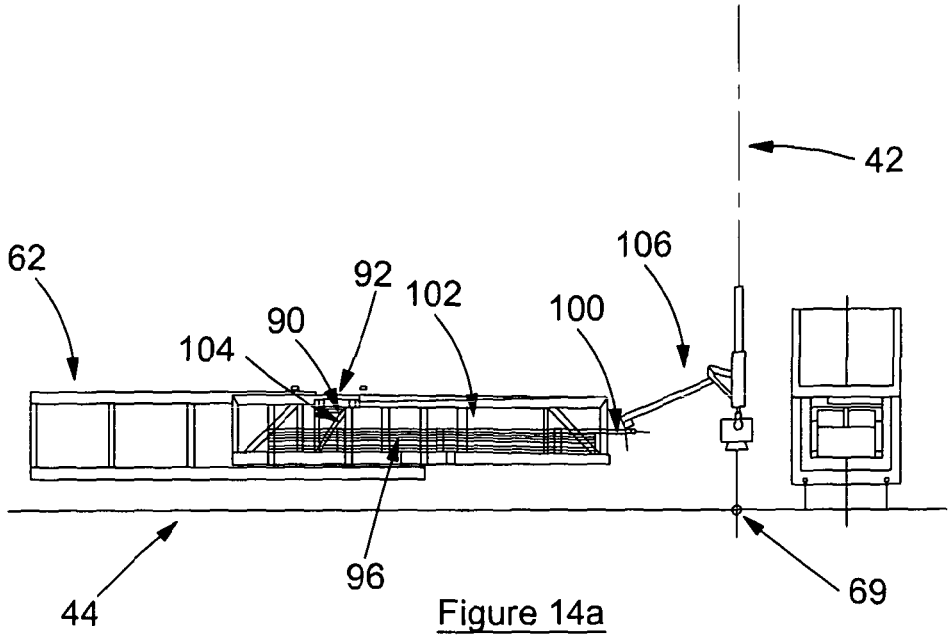
FIGS. 14(*a*) and 14(*b*) show a schematic representation of a tubular storage basket comprising a gripper with a tubular in a first partially deployed configuration and a second partially deployed configuration respectively.
Figure 14B:
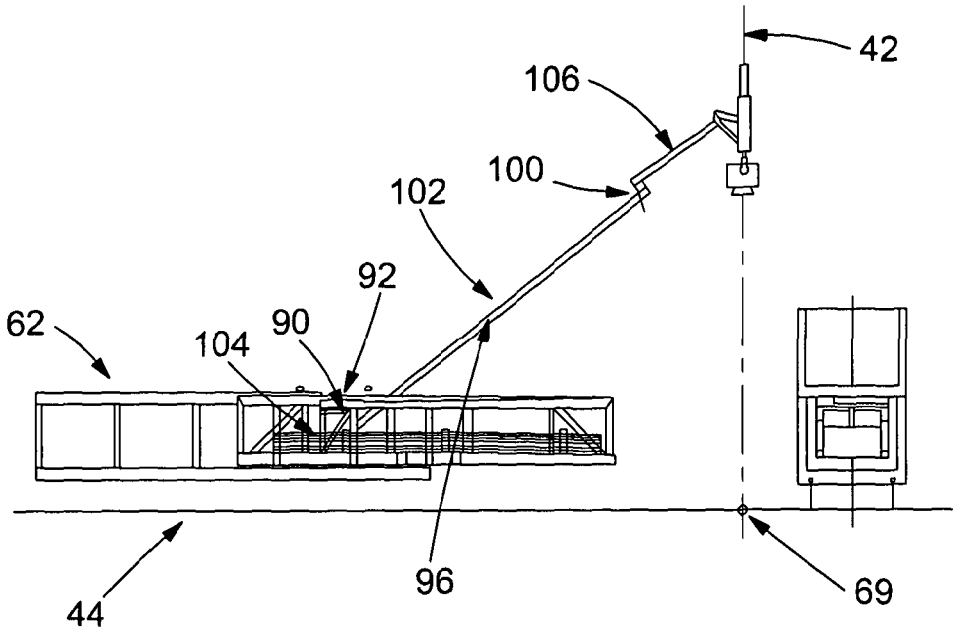

FIG. 11 shows the tubular storage basket 62 of FIG. 7 with an exploded view of the skid system 68. The tubular storage basket 62 attaches to skids 82*a* via attachment pins 66*a*. The tubular storage basket 62 comprises an inner basket 84 and an outer basket 86. The inner basket 84 traverses along outer basket rails 88*a*. Typically, the inner basket 84 is extended longitudinally from the outer basket 86 for deployment or retrieval of tubulars 96. A gripper 90 is housed in an inner basket carriage 92, which traverses along the inner basket 84 on inner basket rails 94*a*. The inner basket 84 houses an arrangement of riser tubulars 96. The inner basket carriage 92, shown in detail in FIG. 12, positions the gripper 90 with respect to the inner basket 94. The inner basket carriage 92 comprises a cylinder 98 for positioning the gripper 90 vertically and a screw mechanism 99 for positioning the gripper 90 laterally. During deployment of the riser tubulars 96, the gripper 90 attaches to a tubular 96 at an intermediate portion 102 of the tubular 96 and then moves a selected tubular 96 from a stored position in the arrangement, as shown in FIGS. 13(*a*) and 13(*b*), to a longitudinally extended central position as shown in FIG. 13(*c*). In the central position of FIG. 13(*c*) a first end portion 100 of the riser tubular 96 projects out of the inner basket 84 in a central location at a predetermined height. The first end portion 100 is positioned for engagement with a winch cable 42 with the gripper 90 attached to the tubular 96 at the intermediate portion 102. The gripper 90 releases the tubular 96 and the inner basket carriage 92 traverses away from the winch cable 42 to grip a second end portion 104 of the tubular, distal to the winch cable 42. As shown in FIG. 14(*a*), the first end portion 100 is attached to the winch cable 42 via a lifting crane 106. As the winch cable 42 raises the first end portion 100, the second end portion 104 is supported by the gripper 90. The inner basket carriage 92 traverses towards the winch cable 42 as the first end portion 100 is raised. The gripper 90 rotatably supports the second end portion 104 such that the tubular 96 rotates from a horizontal position to a vertical position as the first end portion 100 is raised. When in the vertical position, the second tubular end portion 104 is manipulated at the moonpool 69, typically for mating to a deployed tubular. The tubular 96 is lowered by the winch cable 42 and the sequence from FIG. 13(*a*) or 13(*b*) through FIGS. 13(*c*) and 14(*a*) to FIG. 14(*b*) is repeated to deploy multiple tubulars 96. Supporting the tubular 96 at two portions 100, 104 throughout deployment of the tubular 96 aids the alignment of the tubular 96 and improves safety by reducing swinging of tubulars 96.

The sequence from FIGS. 13(*a*) and 13(*b*) through FIGS. 13(*c*) and 14(*a*) to FIG. 14(*b*) is reversed for the retrieval of the riser tubulars 96.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A coiled tubing lifting frame for deploying coiled tubing in a riser and supporting the riser, comprising:

an upper portion configured to connect to a drilling rig support;

a lower portion configured to connect to the riser;

an adjustable connector element disposed between and connecting the upper and lower portions, said connector element configured to vertically extend and/or retract the upper and lower portions relative to each other; and a coiled tubing injector mounted on said adjustable connector element between the upper and lower portions, wherein the adjustable connector element positions said coil tubing injector relative to the upper portion and said drilling rig support.

2. The coiled tubing lifting frame of claim 1, wherein the adjustable connector element comprises two hydraulic cylinders.

3. The coiled tubing lifting frame of claim 2, wherein said hydraulic cylinders each comprise shafts connected to the upper portion.

4. The coiled tubing lifting frame of claim 3, wherein said upper portion comprises a lifting interface configured to connect to the support and said cylinder shafts connect to said lifting interface.

5. The coiled tubing lifting frame of claim 4, wherein said support comprises a winch mounted on the drilling rig.

6. The coiled tubing lifting frame of claim 3, wherein said lower portion comprises a riser mating interface configured to connect to the riser, and said hydraulic cylinders connect to said riser mating interface.

7. The coiled tubing lifting frame of claim 1, wherein the adjustable connector element is configured to maintain the riser in tension at a predetermined value, and the coiled tubing lifting frame is suspended from a lifting device such that both a weight of the coiled tubing lifting frame and at least a portion of a weight of the riser are suspended from the lifting device.

* * * * *